United States Patent [19]

Justice

[11] Patent Number: 4,871,281

[45] Date of Patent: Oct. 3, 1989

[54] TRENCHING TOOL FOR INSTALLING PERFORATED PIPE

[76] Inventor: Donald R. Justice, P.O. Box 150219, Cape Coral, Fla. 33915-0219

[21] Appl. No.: 153,441

[22] Filed: Feb. 28, 1988

[51] Int. Cl.[4] ..... E02F 5/10

[52] U.S. Cl. ..... 405/181; 37/83; 37/86; 405/174; 405/180

[58] Field of Search ..... 405/174–183; 38/86, 86 A, 83

[56] References Cited

U.S. PATENT DOCUMENTS

| | | | |
|---|---|---|---|
| 327,274 | 9/1885 | Keith . | |
| 333,114 | 12/1885 | Dougine . | |
| 946,609 | 1/1910 | Loomis . | |
| 1,337,184 | 4/1920 | Adams | 405/174 |
| 1,814,094 | 7/1931 | Rhodes . | |
| 2,935,801 | 5/1960 | Stewart et al. | 37/86 |
| 3,002,299 | 10/1961 | Domagalski | 37/86 |
| 3,022,585 | 2/1962 | Bradley | 37/86 |
| 3,024,546 | 3/1962 | Cramer | 37/86 A |
| 3,332,249 | 7/1967 | Idoine . | |
| 3,583,168 | 6/1971 | Horton . | |
| 3,603,010 | 9/1971 | Polinek | 37/83 |
| 3,659,364 | 5/1972 | Wilson | 37/83 |
| 3,676,941 | 7/1972 | Cohrs et al. | 37/83 X |
| 3,830,373 | 8/1974 | Sixt et al. | 210/489 |
| 3,831,388 | 8/1974 | Wells . | |
| 3,859,809 | 1/1975 | Clayhold et al. . | |
| 3,874,182 | 4/1975 | Potter et al. | 405/180 X |
| 3,908,385 | 9/1975 | Daniel et al. . | |
| 3,998,065 | 12/1976 | Darnell . | |
| 4,164,082 | 8/1979 | Watson | 37/83 |
| 4,255,883 | 3/1981 | Ealy | 37/83 |
| 4,397,585 | 8/1983 | Fouss | 405/183 |
| 4,750,280 | 6/1988 | Dalaine | 37/86 |

FOREIGN PATENT DOCUMENTS

| | | | |
|---|---|---|---|
| 1176064 | 12/1961 | Fed. Rep. of Germany . | |
| 0114721 | 9/1980 | Japan | 405/180 |
| 241300 | 3/1970 | U.S.S.R. | 37/83 |
| 244946 | 3/1980 | U.S.S.R. | 37/83 |

OTHER PUBLICATIONS

Caterpillar, "Where Quality is Reality . . . ," 12 p.
Caterpillar, "Change to Multi-Job Versatility," 8 p.
Caterpillar Industrial Products, Inc., "Undercarriage General," 4 p.

*Primary Examiner*—Dennis L. Taylor
*Attorney, Agent, or Firm*—Fleit, Jacobson, Cohn, Price, Holman & Stern

[57] ABSTRACT

A highly mobile and accurately positionable trenching tool approaches the surface below which the trench is to be dug at an angle of substantially 90°, enters the earth while maintaining the angle of substantially 90°, and continues its path of travel into the earth while maintaining the angle of substantially 90°, until the trenching tool reaches the intended depth of digging operation. Further, the horizontal or width displacement of the trenching tool is limited so that the entry point of the trenching tool occupies a small surface area.

12 Claims, 3 Drawing Sheets

TRENCHING TOOL FOR INSTALLING PERFORATED PIPE

FIELD OF THE INVENTION

This invention is related to an apparatus for digging a trench while simultaneously burying perforated polyethylene pipe covered with a sock drain.

BACKGROUND OF THE INVENTION

It is sometimes necessary at a construction site or along a proposed path of underground utility lines to lower the water table level. One of the methods presently used for the removal of water to lower the water table is the use of vertical wellpoints. Wellpoints are most commonly used in areas which already have some buried obstruction, such as a utility line, making digging of a trench unsuitable. By this wellpoint procedure, a perforated pipe is inserted into a vertical hole to a suitable depth into the ground. The top end of the pipe is connected to a suction pump or to a horizontal pipe located on the ground which interconnects the tops of a series of vertical wellpoints. The horizontal pipe is connected to a suction or vacuum pump. The pump draws water up from the vertical wellpoints that has entered the perforated pipes. The depth of the vertical pipe depends on the suction capacity of the suction pump to raise water from a predetermined depth.

In an alternate wellpointing method, horizontal wellpoint pipe is placed at the bottom of a trench and subsequently covered by soil excavated during digging of the trench. A suction pump is attached to an above-ground end of the pipe to draw up water that enters the pipe until the water table is lowered.

An example of a method of laying drainage pipe is disclosed in U.S. Pat. No. 3,874,182 to Potter et al. In this patent, horizontal wellpoint drainage pipe is buried by excavating a trench using a mechanical digging apparatus. The excavated soil is directed away from the trench. The wellpoint drainage pipe located at the bottom of the trench is covered by backfilling the trench wholly or partially with water-pervious material, other than the excavated soil, so as to promote the flow of ground water to the pipe.

Another method of laying horizontal wellpointing pipe is disclosed in U.S. Pat. No. 3,998,065 to Darnell. In the Darnell patent, a trenching vehicle digs a trench while perforated flexible pipe having a filter material is placed along the bottom of the trench. The pipe is covered as the trench is refilled, and a subsequent evacuating pressure is applied to the pipe by an above-ground pump. As shown in FIG. 5 of the Darnell patent, the trenching mechanism, for initiation of the trench, contacts the ground at an angle of approximately 45°. Then, as described in the patent, the trenching mechanism is activated and rotated to a slightly vertical position for burying non-perforated pipe for later connection to a suction pump. Similarly, withdrawal of the trenching mechanism appears to be along the same line as the initial digging of the trench, whereby the trenching mechanism is moved from its slightly inclined to the vertical position to an angle of approximately 45° along an arc so that the trenching mechanism, when removed from the earth, is at an angle of approximately 45°.

In U.S. Pat. No. 4,397,585 to Fouss et al., an apparatus for inserting foldable conduit below ground is disclosed. A plow lifts the soil to a sufficient height to form a cavity or trench immediately behind the plow. The soil loosened by the plow falls by gravity around a circular conduit laid down behind the advancing plow blade.

U.S. Pat. No. 3,583,168 to Horton discloses a backfill and pipe laying attachment for a side discharge trencher. By this invention, a trench being dug for the reception of pipe is backfilled behind the trencher. An attached vehicle moves along behind the trencher and backfills the trench dug by the trencher, while at the same time pipe is laid along the bottom of the trench.

U.S. Pat. No. 3,332,249 to Idoine discloses a trench digging and refilling apparatus, in which a circular, horizontally oriented conveyor discharges dirt excavated by a digging unit for discharge rearwardly into the trench or laterally alongside the trench, depending on the direction of movement of the circular horizontal conveyor.

Additional examples of earth-excavating equipment are disclosed in U.S. Pat. Nos. 327,274 to Keith, 1,814,094 to Rhodes, 333,114 to Dougine, 946,609 to Loomis, and 3,831,388 to Wells. A rock excavating machine is disclosed in U.S. Pat. No. 2,935,801 to Stewart II et al.

Each of the cited patents requires a large area over which a digging operation is initiated, with a majority of the references including trenching machines which start at a distance from the drive vehicle and are moved towards the drive vehicle until being located in a digging position. A large amount of clearance is thereby required to begin the digging operation so as to have the lowermost point of the trenching machine reach a lowermost point of the trench to be dug.

SUMMARY OF THE PRESENT INVENTION

The present invention overcomes the disadvantages of the prior art by providing a highly mobile and accurately positionable trencher mechanism. The trenching tool approaches the surface below which the trench is to be dug at an angle of substantially 90°, enters the earth while maintaining the angle of substantially 90°, and continues its path of travel into the earth while maintaining the angle of substantially 90°, until the trenching tool reaches the intended depth of the digging operation. Further, the horizontal or width displacement of the trenching tool is limited so that the entry point of the trenching tool occupies a small surface area compared to the trenching tools of the prior art.

Therefore, by the present invention, lowering of the water table is achieved in areas where previously only wellpoint drainage operations have been performed by the vertical insertion of perforated pipes into a hole drilled or punched to a suitable depth. Drainage pipe is placed by the present invention in a fraction of the time traditionally required and with very little clearance for positioning vertical and/or horizontal lengths of drainage pipe.

Further, in the laying of horizontal wellpoint pipe, a greater depth of penetration than previously known has been achieved by the present invention. This is accomplished by a vertically oriented trenching tool, which is vertically lowered into the earth to a predetermined depth, which may be as deep as 30 feet. The trenching tool is preferably located at the end of a boom of a backhoe, where traditionally a stick and bucket have been located, so as to provide increased maneuverability and accuracy of locating the trenching tool in confined areas around existing underground utilities.

It is an object of the present invention to provide a trenching tool which is vertically positioned above the ground and lowered vertically into the ground at an angle of substantially 90°.

It is another object of the present invention to provide a trenching tool which is vertically positioned above the ground and lowered vertically into the ground at an angle of substantially 90°, where the trenching tool is mounted onto a boom of a backhoe tractor.

It is still another object of the present invention to provide a trenching tool which is vertically positioned above the ground and lowered vertically into the ground at an angle of substantially 90°, where the trenching tool is mounted onto a boom of a backhoe tractor to lay perforated drainage pipe horizontally at the bottom of a trench.

It is still yet another object of the present invention to provide a trenching tool which is vertically positioned above the ground and lowered vertically into the ground at an angle of substantially 90°, where the trenching tool is mounted onto a boom of a backhoe tractor to lay perforated drainage pipe horizontally at the bottom of a trench, and the trench is backfilled with the excavated soil or a suitable substitute, such as sand, or a mixture of the excavated soil and suitable substitute.

These and other objects of the invention, as well as many of the intended advantages thereof, will become more readily apparent when reference is made to the following description, taken in conjunction with the accompanying drawings.

DETAILED DESCRIPTION OF THE PREFERRED EMBODIMENTS

Figure 1:
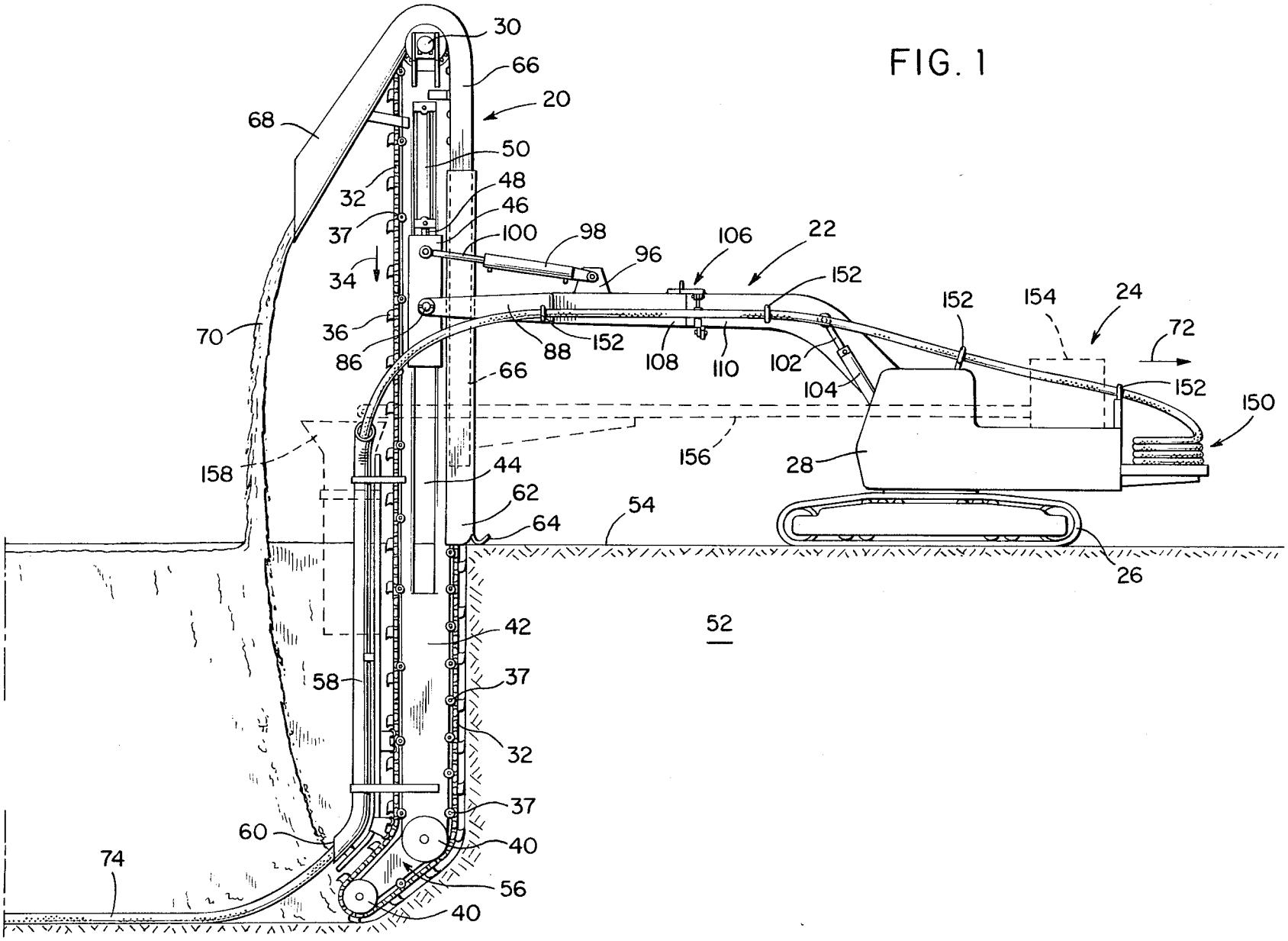
FIG. 1 is an elevational view of a trenching tool mounted on a boom of a backhoe tractor.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings in general, and to FIG. 1 in particular, a trenching tool 20 is generally shown mounted on the end of a boom 22 of a backhoe tractor 24. In FIG. 1, the backhoe tractor is driven by track drive mechanism 26 made of track shoes interconnected by links and driven in a known means. However, it is contemplated as being within the scope of the present invention that the tracks 26 could be tires, as is commonly found on some types of backhoe loaders. Tractor cab 28 is pivotably mounted on track drive mechanism 26 for 360° rotation of the cab and thereby by the boom 22 and the trenching tool 20.

Figure 3:
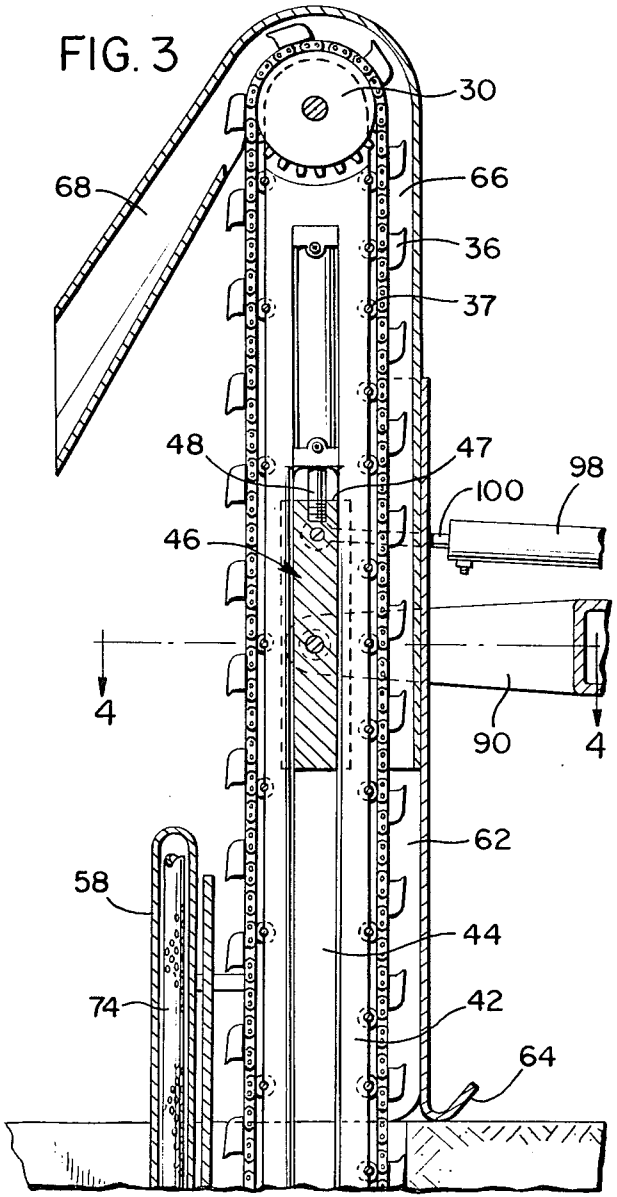
FIG. 3 is a section taken along the line 3—3 of FIG. 2.
Figure 2:
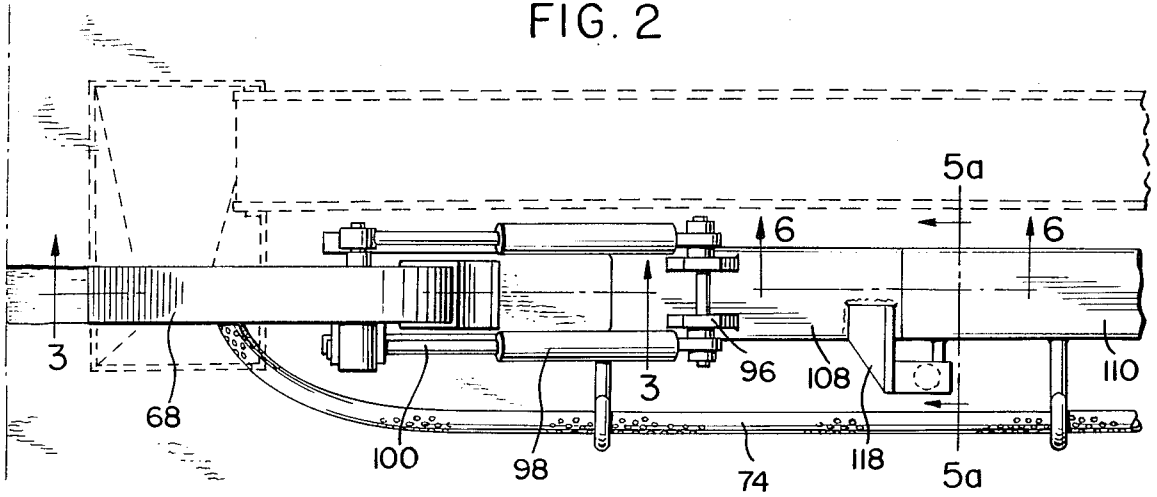
FIG. 2 is a plan view of a section of the trenching tool and boom.

Trenching tool 20 includes hydraulic or electric drive sprocket 30, as shown in FIG. 3. Trained over the drive sprocket 30 is continuous cutter chain 32, which moves over rollers 37 in the direction of arrow 34 shown in FIG. 1 to excavate earth. Secured on the chain 32 is a series of spaced cutter blades 36 or, with reference to FIG. 4, cutter buckets 38. At the bottom of the trenching tool are idle wheels 40 about which the cutter chain is driven. Between the drive sprocket 30 and idle wheels 40 is cutter chain frame 42.

An opening 44 is defined within frame 42 and extends over a majority of the length of the frame 42 from a location adjacent to drive sprocket 30 in a direction downward along the length of the frame, terminating at a location approximately 65 percent of the length of the frame 42. Slidably mounted within opening 44 is sliding depth control block guide 46.

Connected to a top end 47 of block guide 46 is one end of piston 48. The other end of piston 48 is slidably mounted within cylinder 50. The top of cylinder 50 is fixedly mounted to frame 42 adjacent to drive sprocket 30. The overall length of cylinder 50 and, thereby piston 48, has been reduced for illustrative purposes only. It is intended that the cylinder 50 and the piston 48 are of sufficient length so that when the hydraulic piston cylinder assembly 48, 50 is activated, the piston 48 will extend to move the guide 46 along the entire length of opening 44 by extension of piston 48 to force the frame 42, for example, in an upward direction with reference to the fully downwardly extended trenching tool shown in FIG. 1.

The trenching tool is thereby moved from a vertical position extending substantially 90° with respect to the top surface 54 of ground 50 to a position extending into the ground, while maintaining an angle of substantially 90°. Cylinder 50 and piston 48 will lift the trenching tool vertically to approximately one foot clearance above ground level.

When the trenching tool is lowered into the ground at substantially a 90° angle, front end extension 56 is the first portion of the trenching tool to contact the ground. The front end extension 56 extends at an angle of approximately 45° with respect to the remainder of the trenching tool located above the uppermost idle wheel 40. It is important that the extension 56 extend at an angle from the remainder of the trenching tool in order to create an opening within which pipe guide 58 can be lowered into the ground. Since pipe guide 58 is displaced laterally from the frame 42, and the trenching tool is lowered into the ground at an angle of substantially 90°, extension 56 digs an opening within which pipe guide 58 may be lowered into the ground without damage and clogging of its lowermost opening 60.

As the trenching tool is lowered into the ground, sliding backfill deflector 62 engages the ground by flange 64. The deflector 62 is slidably mounted on the auto-backfill deflector 66 and thereby the deflector 62 rides up along the height of the trenching tool as the trenching tool is lowered into the ground.

As shown in section in FIG. 3, deflector 62 is U-shaped and surrounds the cutting buckets 38 so as to form with deflector 66 a covering for the path of travel of the buckets 38 or blades 36 carrying excavated earth above the ground and into the channel formed by deflector 66 and deflector 62.

As the excavated earth travels above ground level into the channel formed by the deflectors 62 and 66, the earth is fed into discharge chute 68 which is an extension of deflector 66. The excavated earth 70 is caused to be redeposited into the trench previously dug by the trenching tool as the tractor 24 moves in the direction of arrow 72. As shown in FIG. 1, the excavated earth 70 refills the trench and buries perforated polyethylene pipe, which is shown in FIG. 1 as covered by a sock drain 74.

Figure 9:
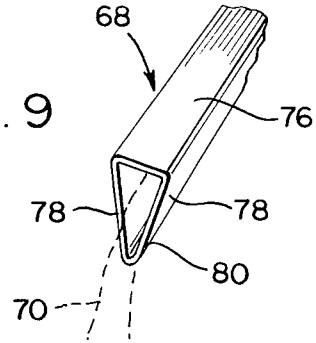
FIG. 9 is a perspective view of the discharge chute shown in FIG. 1.
Figure 5B:
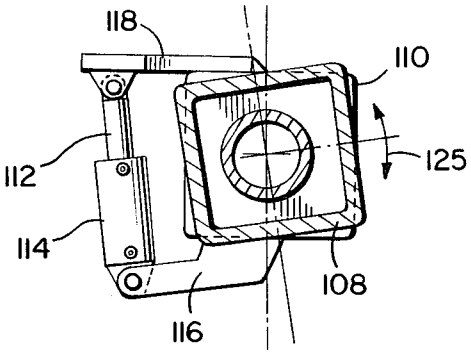
FIG. 5*b* illustrates different sections of the boom being displaced with respect to each other.
Figure 5A:
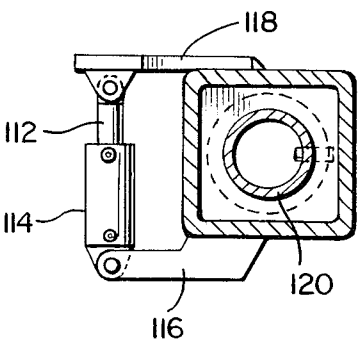
FIG. 5*a* is a section view taken along the line 5*a*—5*a* of FIG. 2.

Delivery chute 68 is shown in greater detail in FIG. 9. In FIG. 9, chute 68 is of a triangular cross-section having a flat upper surface 76. Covering sidewalls 78 extend from top surface 76 and meet at rounded bottom edge 80. Smooth flow of excavated earth is aided by this configuration of the delivery chute.

Figure 4:
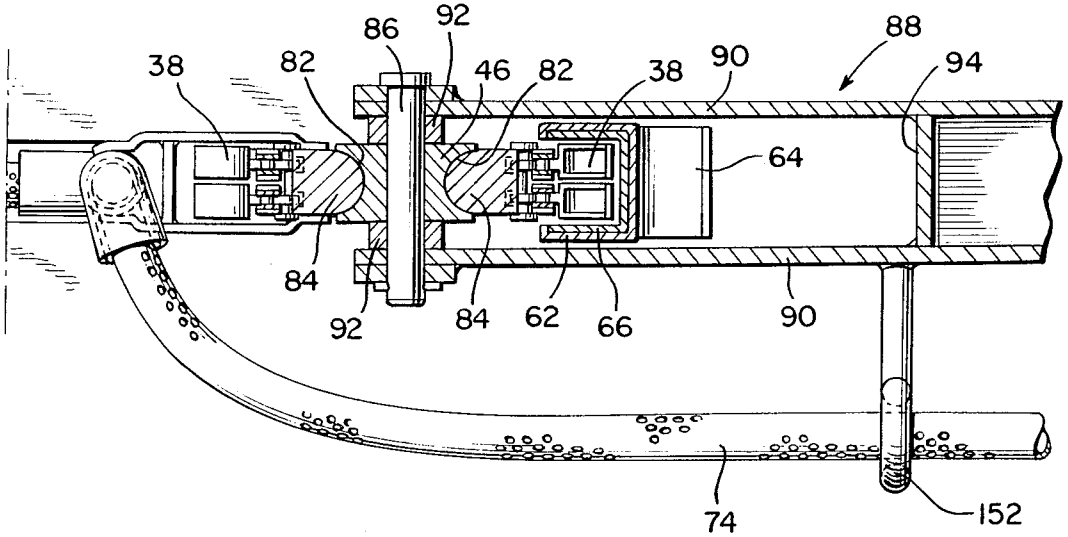
FIG. 4 is a section view taken along the line 4—4 of FIG. 3.

In FIG. 4, details of the depth control block guide 46 are shown. Depth control block guide 46 includes two opposite concave surfaces 82. Matingly engaging with the curved surfaces 82 are convex projections 84 of the frame 42. Crosspin 86 anchors the depth control block on the forked end 88 of the boom 22. End 88 includes two legs 90, which are engaged by crosspin 86 and spacing blocks 92. The legs 90 of the U-shaped end of the boom 22 are interconnected by crosspiece 94.

Extending from projections 96 on opposite sides of the trenching tool are cylinders 98 and pistons 100. One end of each cylinder 98 is anchored to one of the projections 96, whereas a remote end of each of the cylinders 100 is secured to the depth control block guide 46, as shown in FIG. 3. If it is desired to change the angle of entry or angle of excavation of the trenching tool, hydraulic piston cylinder assemblies 98, 100 are actuated by known means to thereby tilt the angle of the trenching tool by extension or retraction of the piston 100. It is envisioned that the tilting angle of the trenching tool may be varied between 45° and 135° so that it is even possible to excavate the earth underneath the tractor.

Similarly, the height of the boom may be raised and lowered by a piston 102 and cylinder 104 assembly located on each side of the boom. Piston 102 is pivotally secured to the boom 22, whereas cylinder 104 is pivotably mounted on the tractor 24. Another piston cylinder assembly 102, 104 is mounted on the opposite side of the boom from that shown in FIG. 1.

During a trenching operation, the ground over which the tracks 26 of the tractor 24 travel may vary in levelness. To compensate for any inclination of the tractor from a horizontal position as the tractor moves across the ground, a compensating device 106 is incorporated into the boom 22. This avoids any twisting stress on the trenching device 20 during a trenching operation.

In FIGS. 1, 5*b*, 6, and 7, the boom is shown divided into sections 108 and 110. When the tractor is inclined from a horizontal position, piston cylinder assembly 112, 114 is activated to move boom section 110 relative to boom section 108. Piston cylinder assembly 112, 114 is pivotally mounted on one end to an arm 116, which extends from boom section 110. The other end of the piston assembly 112, 114 is pivotally connected to a bracket 118, which extends from boom section 108. Piston 112 is extended or retracted to compensate for the divergence from the horizontal of the tractor 24 so as to move one boom section relative to the other along the direction of arrow 125.

Figure 6:
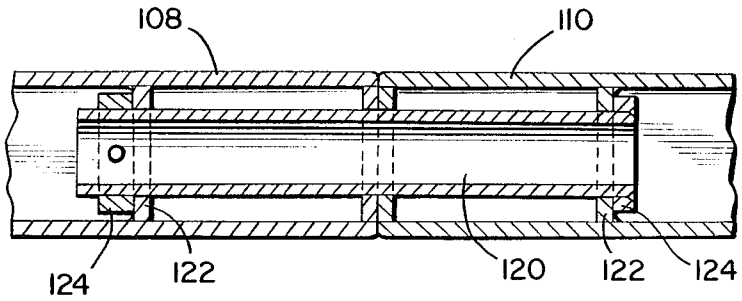
FIG. 6 is a section view taken along the lines 6—6 of FIG. 2.

As shown in FIG. 6, a connection pin 120 extends centrally from boom sections 108 and 110 and is anchored behind wall sections 122 by anchor nuts 124. This arrangement allows the turning of boom section 108 with respect to boom section 110 about shaft 120.

Figure 8:
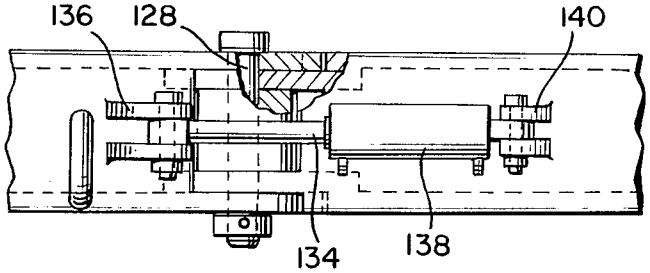
FIG. 8 is a side view, partially in section, of the boom shown in FIG. 7.

In FIG. 8, the horizontal adjusting assembly 106 shown in FIGS. 1, 2, 5*a*, 5*b*, and 6 is also shown and used in a similar manner. However, in FIGS. 7 and 8, increased maneuverability for the boom, and thereby for the placement and digging by the trenching tool, is possible by use of a horizontal hydraulically activated swivel assembly 129.

Figure 7:
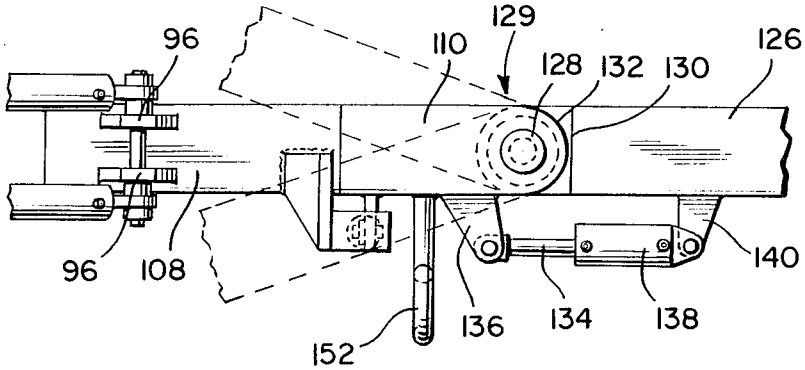
FIG. 7 is an additional embodiment of a pivotal connection of different sections of the boom.

In FIG. 7, boom section 110 is divided from another section 126 of the boom. Sections 110 and 126 are pivotably interconnected about pin 128. An area 130 of section 126 is recessed from semi-circular end 132 of boom section 110.

Piston 134 is pivotably mounted on bracket 136 which is mounted on boom section 110. Cylinder 138 is pivotably mounted on bracket 140, which is mounted on boom section 126. By actuation of piston cylinder assembly 134, 138, boom sections 108 and 110 may be moved with respect to boom section 126 to the positions shown in phantom in FIG. 7 and beyond. A swivel angle of approximately 180° is possible so as to move boom sections 108, 110 at an angle of approximately 90° with respect to boom section 126. By the use of the swivel apparatus, the tractor cab may be turned perpendicular to its tracks, and the trenching tool may be turned parallel to the tracks by the swivel assembly to install a sock drain in a swale area in a direction extending parallel to a road, with the tracks of the tractor sitting on the roadway and extending parallel to the roadway.

The connection hoses for each of the piston cylinder assemblies have been omitted for the sake of clarity. These piston cylinder assemblies operate in a known manner to extend a piston from a cylinder and to retract a piston into a cylinder.

In operation, the trenching tool is lowered at a 90° angle vertically into the ground from a distance of approximately one foot above the ground. The cutting blades or buckets are simultaneously driven to excavate earth from extension 56 of the trenching tool up into the channel defined by deflectors 62 and 64 and over the top of the drive sprocket into backfill chute 68. Initially, one end of a polyethylene drainage pipe covered with a sock drain is sealed off and fed from a supply roll 150 through a series of eye hooks 152 into pipe guide 58. The pipe exits through the bottom of pipe guide 58 and is played out at the bottom of the trench dug by the trenching tool.

The excavated earth 70 is raised through the channel formed by deflectors 62, 66 to a point above the drive sprocket and deposited into the backfill chute 68. The soil falls from the chute onto the length of perforated pipe covered with sock drain 74 and buries the perforated pipe at the bottom of the trench, as shown in FIG. 1. As the tractor 24 moves in the direction of arrow 72, a continuous length of perforated pipe is buried. Additional sections of perforated pipe may be secured together so that the total length of buried pipe may be as long as it is possible for the later attached pump to draw water from the perforated pipe at the end of the buried line of pipe.

When the length of buried pipe is to be ended, a section of non-perforated pipe is attached to the last portion of buried perforated pipe. The trenching tool is raised vertically at an angle of 90° so as to vertically bury the length of non-perforated pipe such that its terminal end is located above the upper surface of the ground. A pump is connected to the terminal end of the length of non-perforated buried pipe which projects above the level of the ground so as to evacuate water which seeps into the perforated pipe through the sock drain. Continuous evacuation of water from the buried pipe lowers the ground water table for subsequent dry soil excavation of the land above the buried perforated pipe.

Sand or a mixture of sand and soil can be used as an alternate backfill material. If only soil is used as the backfill, the direction of chute 68 is turned so that the soil excavated from the trench is deposited alongside the trench. Backfill material is provided from hopper 154 (shown in phantom) and conveyed to the trench by endless conveyor belt 156 (shown in phantom). The conveyor terminates at deposit chute 158 (shown in phantom), which deposits the sand onto the perforated pipe at the bottom of the trench.

Having described the invention, many modifications thereto will become apparent to those skilled in the art to which it pertains, without deviating from the spirit of the invention as defined by the scope of the appended claims.

I claim:

1. A trenching apparatus for installing perforated pipe, said trenching apparatus comprising:

drive means for moving along a path of burial of perforated pipe, a boom having two ends, one end being connected to said drive means, a trenching tool, the other end of said boom being pivotally connected to said trenching tool, said trenching tool including earth excavating means for forming a trench by lifting excavated earth, and height adjustment means for vertically adjusting the height of said earth excavating means with respect to said boom.

said excavating means including a continuous chain having spaced cutting means trained about a frame for digging of earth, said frame being substantially straight except for an angled terminal end which initiates excavation of the earth by said cutting means, said terminal end being angled so as to provide an entry path into the trench dug by said trenching tool for a guide for perforated pipe and thereby to prevent blockage of said guide by the earth.

2. A trenching apparatus as in claim 1, wherein said guide is moved from above the ground to a bottom of the trench when said trenching tool is located below ground level.

3. A trenching apparatus as in claim 1, wherein said height adjustment means is actuated for raising and lowering said trenching tool at an angle of substantially 90°.

4. A trenching apparatus as in claim 1, wherein said trenching tool includes two deflectors, one of said two deflectors being slidably mounted on the other of said two deflectors to contact the top surface of the earth when said trenching tool is lowered into the earth and to form a channel with said other deflector for containing excavated earth as the excavated earth is removed from below the top surface of the earth by said earth excavating means.

5. A trenching apparatus as in claim 1, wherein said boom includes a leveling assembly for turning of one section of said boom with respect to another section of said boom to maintain constant the angle of said trenching tool while the angle of inclination of said drive means varies.

6. A trenching apparatus as in claim 1, wherein said boom includes a swivel assembly for turning a section of said boom with respect to another section of said boom at an angle up to 90°.

7. A trenching apparatus for installing perforated pipe, said trenching apparatus comprising:

tractor means for moving the trenching apparatus along a path of burial of perforated pipe, boom means for interconnecting said tractor means and a trenching tool, said boom means being pivotably mounted on said tractor means, said trenching tool including excavation means for excavating the ground when said trenching tool is lowered into the ground, and adjustment means for adjusting the vertical height of said excavation mans relative to said boom for lowering said excavation means into the ground and for withdrawing said excavation means from the ground.

said trenching tool including two deflectors mounted adjacent to said excavation means, one of said deflectors being slidably mounted on the other of said deflectors to contact the top surface of the earth when said trenching tool is lowered into the earth and to form a channel with said other deflector for containing excavated earth as the excavated earth is removed from below the top surface of the earth by said earth excavating means.

8. A trenching apparatus as in claim 7, wherein said excavation means is lowerable into the ground at an angle of substantially 90° by said adjustment means.

9. A trenching apparatus as in claim 7, wherein said boom includes a swivel assembly for turning a section of said boom with respect to another section of said boom at an angle up to 90° so that said trenching tool digs a trench which parallels and is spaced laterally from said tractor means as said tractor means moves in a direction of said path of burial of perforated pipe.

10. A trenching apparatus as in claim 7, wherein said boom includes a leveling assembly for turning of one section of said boom with respect to another section of said boom to maintain constant the angle of said trenching tool while the angle of inclination of said tractor means varies.

11. A trenching apparatus as in claim 7, wherein said excavation means includes a continuous loop having spaced cutting means trained about a frame for excavating earth, said frame being substantially straight except for an angled terminal end which initiates excavation of the earth.

12. A trenching apparatus for installing perforated pipe, said trenching apparatus comprising:

drive means for moving along a path of burial of perforated pipe, a boom having two ends, one end being pivotably mounted on said drive means, a trenching tool, the other end of said boom being connected to said trenching tool, said trenching tool including earth excavating means for forming a trench by lifting excavated earth, and height adjustment means for vertically adjusting the height of said earth excavating means with respect to said boom, said boom being separated into two sections and including swivel means for connecting said two sections and for turning one section with respect to the other section at an angle up to 90° so that by pivoting said trenching tool to a side of said drive means and turning said one section 90° with respect to said other section, a trench may be dug spaced laterally and paralleling the path of movement of said drive means.

* * * * *